US005862435A

United States Patent [19]

Suzumi et al.

[11] Patent Number: 5,862,435

[45] Date of Patent: Jan. 19, 1999

[54] IMAGE FORMING APPARATUS

[75] Inventors: Masahiko Suzumi; Toshio Miyamoto; Satoru Izawa, all of Numazu, Japan

[73] Assignee: Canon Kabushiki Kaisha, Tokyo, Japan

[21] Appl. No.: 7,190

[22] Filed: Jan. 15, 1998

[30] Foreign Application Priority Data

Jan. 21, 1997 [JP] Japan ..... 9-022193

[51] Int. Cl.[6] ..... G03G 15/20

[52] U.S. Cl. ..... 399/68; 399/69; 399/405

[58] Field of Search ..... 399/43, 45, 68, 399/69, 322, 405; 271/184, 298, 207

[56] References Cited

U.S. PATENT DOCUMENTS

| | | | |
|---|---|---|---|
| 4,750,016 | 6/1988 | Kusumoto et al. | 399/405 |
| 4,945,390 | 7/1990 | Hasegawa et al. | 399/405 |
| 5,164,570 | 11/1992 | Okimura | 219/216 |
| 5,170,215 | 12/1992 | Pfeuffer | 399/68 |
| 5,237,381 | 8/1993 | Hamada | 399/406 |
| 5,253,024 | 10/1993 | Okuda et al. . | |
| 5,293,202 | 3/1994 | Adachi et al. . | |
| 5,307,134 | 4/1994 | Nakajima et al. | 399/45 |
| 5,722,026 | 2/1998 | Goto et al. . | |

FOREIGN PATENT DOCUMENTS

| | | |
|---|---|---|
| 63-313182 | 12/1988 | Japan . |
| 2-157878 | 6/1990 | Japan . |
| 4-44075 | 2/1992 | Japan . |
| 4-204980 | 7/1992 | Japan . |
| 5-058529 | 3/1993 | Japan . |
| 5-134502 | 5/1993 | Japan . |

*Primary Examiner*—Robert Beatty

*Attorney, Agent, or Firm*—Fitzpatrick, Cella, Harper & Scinto

[57] ABSTRACT

An image forming apparatus comprises a fusing device for heating and fixing an unfixed image on a recording material while feeding the recording material, reversing device for reversing the recording material after passing the fusing device. The image forming apparatus operates in a first mode in which the recording material which passed the fusing device is ejected to an ejection section directly without being reversed, and a second mode in which the recording material which passed said fusing device is ejected to an ejection section after being reversed by the reversing device. A throughput of the recording material fed and/or the fusing temperature of the fusing device in the first mode being smaller or lower during at least part of an image forming process than in the second mode. With this image forming apparatus, the recording materials can be stacked in the ejection portion with improved quality and an excessive rise of temperature in the vicinity of the ejection portion can be avoided.

19 Claims, 7 Drawing Sheets

IMAGE FORMING APPARATUS

BACKGROUND OF THE INVENTION

1. Field of the Invention

The present invention relates to an image forming apparatus utilizing electrophotographic techniques or electrostatic recording techniques, such as a copying machine, a facsimile and a laser printer provided with a heating type fuser.

2. Description of the Related Art

It has been customary in an image forming apparatus utilizing electrophotographic techniques, such as a laser printer, that commands related to printing and coded character and pictorial image information are received from external image processing equipment such as a computer, and when the coded information is converted into image information by a formatter or the like, pictorial images having density information, such as photographs, are binary-coded through known image processing, e.g., the dither matrix process or the error diffusion process, for conversion into the image information. After that, the image information is printed in an electrophotographic engine.

In one of the known electrophotographic engines, an electrostatic latent image is formed by writing an electrostatic image, based on the image information, on an electrophotographic photosensitive member or an electrostatic recording dielectric member which is uniformly charged beforehand; e.g., optically scanning over a photosensitive surface by a semiconductor laser. Also, one of the known developing devices for developing the electrostatic latent image performs development in such a manner, for example, that in a developing region where an electrostatic latent image carrier and a developer carrier are positioned to face each other with a small gap therebetween, a developer is moved from the developer carrier onto the surface of the electrostatic latent image carrier to form a developer (toner) image corresponding to the electrostatic latent image. The toner image thus developed is transferred onto a sheet of recording paper (material) by transfer means.

Subsequently, the recording paper onto which the toner image has been transferred is separated from the electrostatic latent image carrier and sent to fusing means, e.g., a known heating type fuser, where the toner image is fused and fixed to the recording paper.

As heating type fusers, hot-roller fusers have been widely used in the past, and film heating fusers have been used recently. In film heating fusers, particularly, no power is supplied to the fusers in the standby state and power consumption is held as low as possible. More specifically, a heat-fusing method using the film heating technique that a toner image is fused and fixed to a sheet of recording paper through a film interposed between a heater and a press roller, is proposed in Japanese Patent Laid-Open No. 63-313182, No. 2-157878, No. 4-44075, No. 4-204980, etc.

FIG. 7 schematically shows the principal part of a film heating fuser as one example of such heating type fusers. In FIG. 7, the fuser comprises a heating member (referred to as a heater hereinafter) 101 fixedly supported by a stay holder (support) 102, and an elastic press roller 110 held in pressure contact with the heater 101 while a fusing nip portion N is formed in a predetermined nip width, with a heat-resistant, thin film (referred to as a fusing film) 103 sandwiched therebetween. The heater 101 is heated and adjusted to a predetermined temperature upon supply of electric power. The fusing film 103 is a member in the form of a cylinder, an endless belt or a rolled web having ends, and is moved in the direction of an arrow a by the rotating force of not-shown driving means or the press roller 110 while closely contacting with and sliding over the surface of the heater 101 in the fusing nip portion N.

Under the condition where the heater 101 is heated and adjusted to the predetermined temperature and the fusing film 103 is moved in the direction of the arrow, when a sheet of recording paper P having a not-yet-fused toner image t formed and carried thereon as an object to be heated is introduced between the fusing film 103 and the press roller 110 in the fusing nip portion N, the recording paper P is brought into close contact with the surface of the fusing film 103 and transported through the fusing nip portion N along with the fusing film 103 while being held in sandwiched relation. In the fusing nip portion N, the recording paper P and the toner image t are heated by the heater 101 through the fusing film 103 so that the toner image t on the recording paper P is fused and fixed under heating. A part of the recording paper P having passed the fusing nip portion N is peeled off from the surface of the fusing film 103 and then further transported.

FIG. 8 shows the background art of the present invention and is a partial view of an image forming apparatus provided with the heating type fuser mentioned above.

In the image forming apparatus provided with the heating type fuser mentioned above, as the printing speed increases, ejected sheets of recording paper are stacked one above another in a paper ejection tray under the condition where the paper temperature still remains high and the charged static electricity is not yet attenuated.

Particularly, in the F/U (faceup) paper ejection mode in which the sheets of recording paper P are each ejected and stacked with the surface including the toner image t (i.e., the printed surface) facing up, as shown in FIG. 8A, the above tendency is more remarkable because the feed path of the recording paper is shorter and the recording paper is stacked more immediately after being fed out of the fuser than in the F/D (facedown) paper ejection mode in which the sheets of recording paper P are each ejected and stacked with the printed surface facing down, as shown in FIG. 8B. Therefore, when sheets of recording paper having relatively small thermal capacity and high volume resistivity, such as OHP sheets, are fed in the F/U paper ejection mode, the sheets of recording paper ejected to a paper ejection tray 130 still remain at such a high temperature that the sheets lack firmness and the toner is not solidified sufficiently, and still have the charged static electricity not yet attenuated. This may result in the OHP sheets not being stacked one above another satisfactorily because the adhesive force of the toner, the force of returned static electricity, etc. cause the sheets to stick to each other or curl.

Further, in the F/U paper ejection mode, because the sheets of recording paper are generally stacked on the tray 130 which is disposed downstream of a fuser 100 in the direction of pass of the recording paper and is opened as shown in FIG. 8A, paper ejection members 131 (131*a*, 131*b*) (such as paper ejection guides) of the fuser are exposed to the exterior such that the user may easily touch them. Nevertheless the paper ejection members are often heated excessively; hence the user feels unpleasant upon touching those members in such a condition.

SUMMARY OF THE INVENTION

An object of the present invention is to provide an image forming apparatus with which sheets of recording material can be stacked in a recording-material ejection section with better quality.

Another object of the present invention is to provide an image forming apparatus which can prevent an excessive rise of temperature in the vicinity of the recording-material ejection section.

Still another object of the present invention is to provide an image forming apparatus wherein, in at least part of an image forming process, a throughput of recording material fed in a first mode in which the recording material having passed fusing means are ejected to an ejection section directly without being reversed is smaller than a throughput of the recording material fed in a second mode in which the recording material are ejected to an ejection section after being reversed by reversing means.

Still other objects of the present invention will be apparent from the following detailed description.

DETAILED DESCRIPTION OF THE PREFERRED EMBODIMENTS

Preferred embodiments of the present invention will be described below with reference to the drawings.

<First Embodiment>

Figure 1:
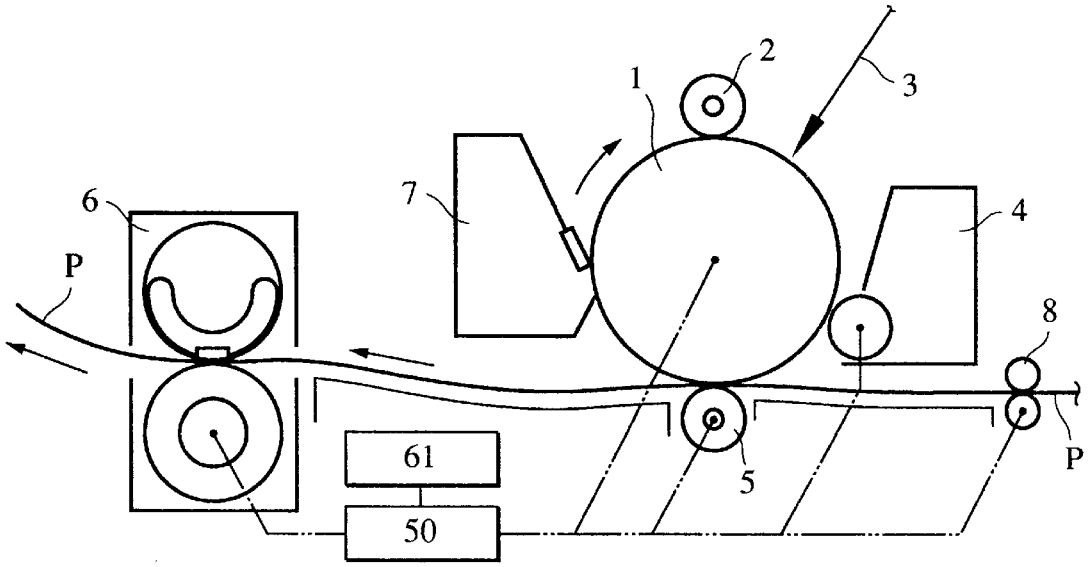
FIG. 1 is a schematic view showing the construction of an image forming apparatus according to the present invention.

FIG. 1 is a schematic view showing the construction of an image forming apparatus according to the present invention.

In FIG. 1, denoted by reference numeral 1 is a photosensitive drum made by forming a photosensitive material, such as OPC, amorphous Se or amorphous Si, on a cylindrical base of aluminum or nickel, for example. The photosensitive drum 1 is driven to rotate in the direction of an arrow. The surface of the photosensitive drum 1 is first uniformly charged by a charging roller 2 as a charging device. Then, an electrostatic latent image is formed by scanning a laser beam 3, which is on/off controlled in accordance with image information, over the surface of the photosensitive drum 1 for exposure. The electrostatic latent image is developed by a developing device 4 for conversion into a visible (toner) image. The development can be performed by the jumping development process, the two-component development process, the FEED development process, etc. In many cases, image exposure and reversal development are used in combined manner.

Denoted by 5 is a transfer roller as means for transferring the toner image onto a sheet of recording paper (material) P. When the recording paper P fed from a paper feed section (not shown), e.g., a paper feed cassette, is supplied by a pair of regist rollers 8 at the predetermined timing to a position (transfer section) confronting the photosensitive drum 1, a transfer bias is applied to the recording paper P from the underside, causing the toner image to be transferred onto the recording paper P. At this time, the recording paper P is transported between the photosensitive drum 1 and the transfer roller 5 while being subject to a certain pressing force. The recording paper P onto which the toner image has been transferred is transported to a fusing device (heating type fuser) 6 where the toner image is fused and fixed as a permanent image. On the other hand, the photosensitive drum 1 from which the toner image has been transferred rotates to a cleaning device 7 where deposits remaining on the drum surface, such as the toner left after the transfer step, is removed. After that, the photosensitive drum 1 is used again for a next image forming process.

The above-mentioned components are driven by the driving force transmitted from driving means 50 through gears, clutches, etc. (not shown), and the driving means 50 is controlled by a driving controller 61 so that the components are driven at respective appropriate speeds (in match with the process speed) and timed relationship.

Incidentally, the image forming apparatus of this embodiment can perform printing on condition of 600 dpi and 16 sheets/min (the process speed of about 94 mm/sec).

Figure 2:
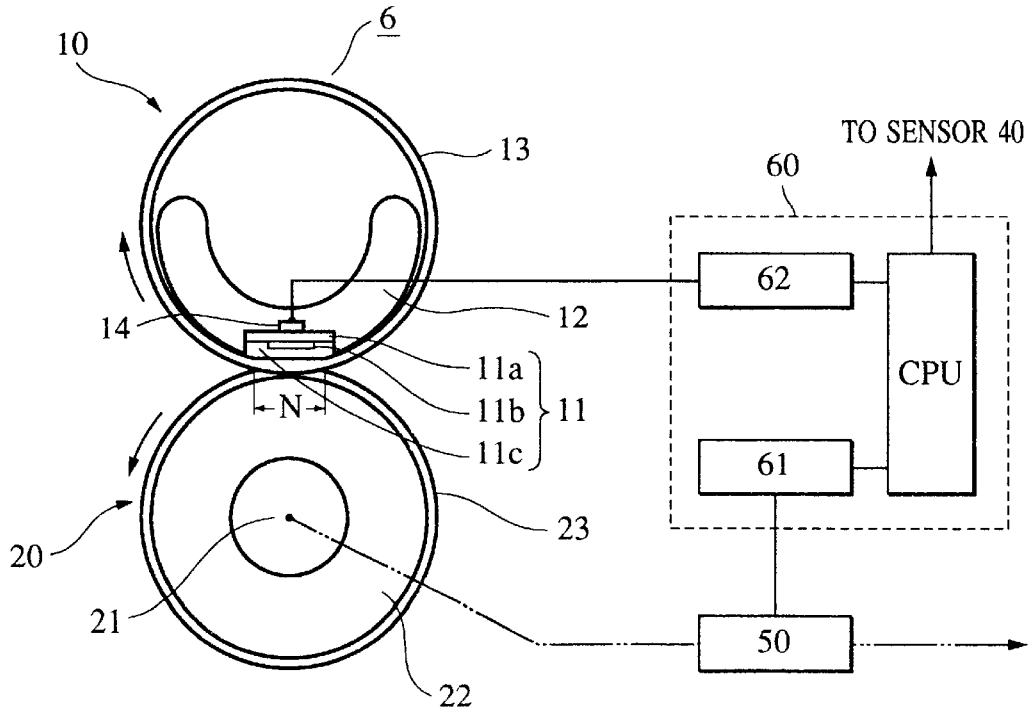
FIG. 2 is a schematic view showing the construction of a heating type fuser incorporated in the image forming apparatus of FIG. 1.

FIG. 2 schematically shows the construction of the heating type fuser 6 for use in this embodiment. In FIG. 2, an upper unit 10 comprises a fusing film 13, a fusing heater 11, and a heat-insulating stay holder 12. The fusing film 13 is a hollow cylindrical film which has so small thermal capacity with a thickness not larger than 100 $\mu$m as to permit quick start, and is formed of heat-resistant, flexible materials such as polyimides, polyamide imides, PEEK, PES, PPS, PFA, PTFE, and FEP. From the other standpoint of constructing the heating type fuser having long life, the fusing film 13 is required to have a thickness not less than 20 $\mu$m so that the film has sufficient strength and superior durability. Accordingly, the thickness of the fusing film 13 is optimally in the range of not larger than 100 $\mu$m but not less than 20 $\mu$m. In addition, to prevent an offset of the recording paper and ensure easiness in separation thereof from the fusing film 13, a heat-resistant resin having a good separation property, such as PFA, PTFE or FEP, is coated either in combination or alone on the fusing film 13 to form a surface layer. The fusing heater 11 is disposed inside the fusing film 13 as a member for heating it in a nip region N to fuse and fix the toner image on the recording paper. The heat-insulating stay holder 12 supports the fusing heater 11 while preventing radiation of heat in the direction opposed to the nip portion N, and is formed of a liquid crystal polymer, a phenol resin, PPS, PEEK or the like. The fusing film 13 is arranged to surround the heat-insulating stay holder 12 in such a manner that the heat-insulating stay holder 12 rotatably supports the fusing film 13 in the direction of an arrow. Because the fusing film 13 is rotated in slide contact with the fusing heater 11 and the heat-insulating stay holder 12 both disposed inside the fusing film 13, it is preferable to hold down small frictional resistance of the fusing film 13 with respect to the fusing heater 11 and the heat-insulating stay holder 12. For this purpose, a small amount of lubricant, e.g., grease, is applied to the surfaces of the fusing heater 11 and the heat-insulating stay holder 12. This enables the fusing film 13 to rotate smoothly.

Denoted by 20 is a lower unit constituted by a press roller, as a back-up member, which comprises a core bar 21 and an elastic layer 22 formed by foaming a heat-resistant rubber such as silicone rubber or fluorine-contained rubber, for example, around the core bar 21. A layer 23 of PFA, PTFE, FEP or the like may be formed on the elastic layer 22 to enhance a separation property of the press roller 20. The press roller 20 is pressed by pressing means (not shown) in the direction toward the upper unit 10 through both longitudinal ends thereof under sufficient force to form the nip portion N necessary for fusing and fixing of the toner image. Also, the press roller 20 is driven to rotate in the direction of an arrow by the driving force transmitted from the driving means 50 to the core bar 21 through one longitudinal end. This causes the fusing film 13 to rotate in the clockwise direction, as indicated by an arrow in FIG. 2, around the stay holder 12 following the rotation of the press roller 20. As an alternative, a driving roller (not shown) may be disposed inside the fusing film 13 to rotate the fusing film 13.

Figure 3:
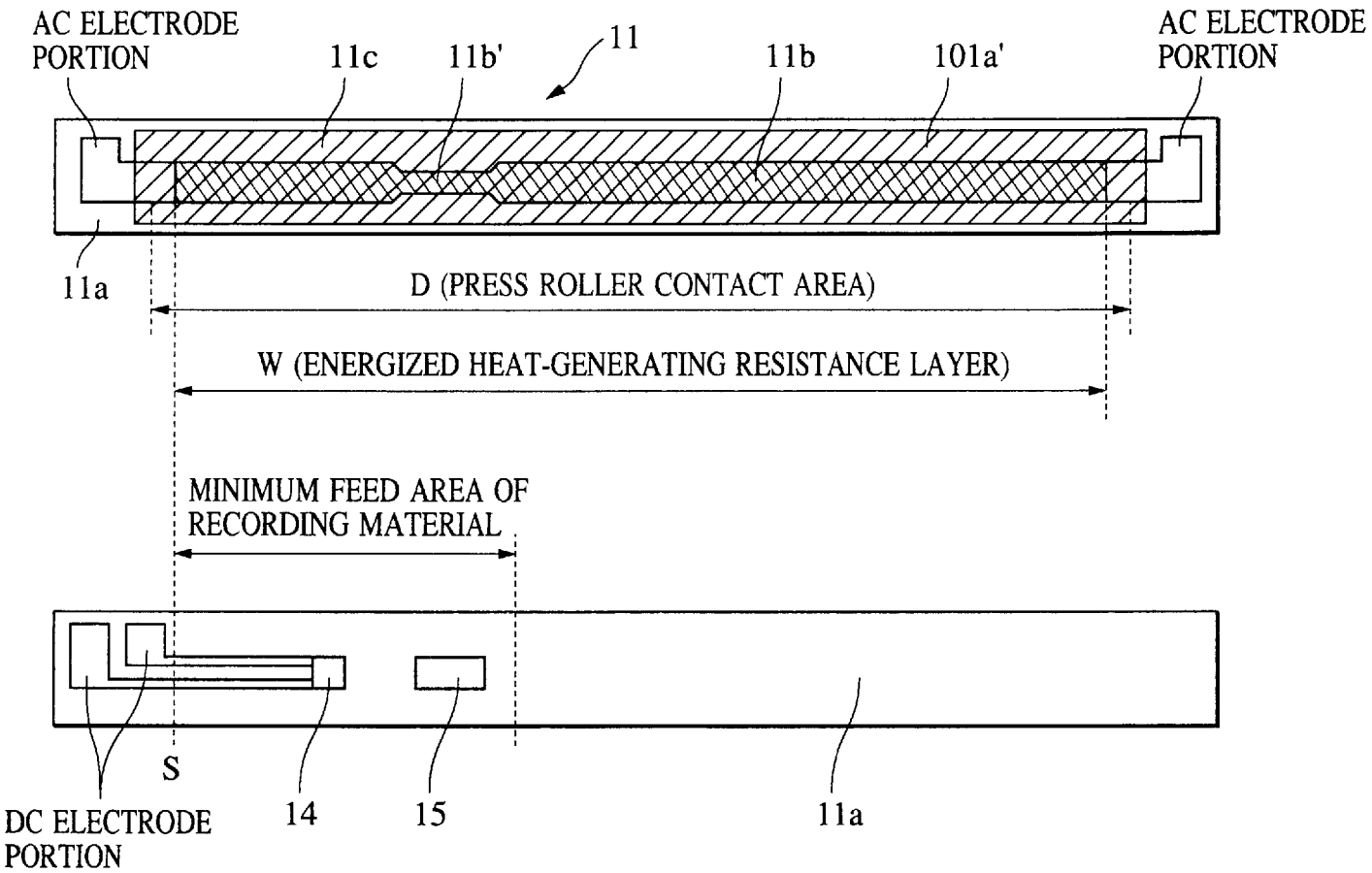
FIG. 3 is a schematic view of a heating member built in the heating type fuser of FIG. 2.

As shown in FIG. 3, the fusing heater 11 in this embodiment comprises a ceramic base plate 11*a*, a heat-generating resistance layer 11*b* formed on the ceramic base plate 11*a*, and a glass protective layer 11*c* formed on the heat-generating resistance layer 11*b*. The fusing heater 11 generates heat when electric power is supplied to the heat-generating resistance layer 11*b*. The temperature of the fusing heater 11 is detected by a temperature sensor 14 disposed on one surface of the base plate 11*a* opposite to the other surface thereof on which the heat-generating resistance layer 11*b* is formed. Based on a detection signal from the temperature sensor 14, a temperature controller 62 of temperature means 60 changes the amount of power supplied to the heat-generating resistance layer 11*b* so that the fusing heater 11 is controlled to provide an appropriate fusing temperature.

The heating type fuser 6 will be described in more detail. A ceramic heater is generally used as the heater 11 which constitutes a heating member. The ceramic base plate 11*a* is made of alumina, for example, so as to have positive electric insulation, good thermal conductivity and low thermal capacity, and the heat-generating resistance layer 11*b* of silver-palladium (Ag/Pd), $Ta_2N$, for example, is formed by, e.g., screen printing on the other surface of the ceramic base plate 11*a* (the surface thereof facing the fusing film 13) in the longitudinal direction of the base plate 11*a* (i.e., in the direction vertical to the drawing sheet of FIG. 2). Furthermore, the glass protective layer 11*c* is formed in thin thickness on the surface of the heat-generating resistance layer 11*b*. In the ceramic heater 11 thus constructed, the heat-generating resistance layer 11*b* generates heat when electric power is supplied to it, and the whole heater including the ceramic base plate 11*a* and the glass protective layer 11*c* is heated to rise in temperature quickly.

Such a temperature rise of the heater 11 is detected by the temperature sensor 14 disposed on the back side of the heater 11, and a detected value is fed back to the temperature controller 62. The temperature controller 62 controls supply of electric power to the heat-generating resistance layer 11*b* so that the heater temperature detected by the temperature sensor 14 is maintained almost at a constant temperature (fusing temperature). In other words, the heater 11 is heated and adjusted to provide a predetermined fusing temperature by temperature control.

Moreover, the stay holder 12 is formed of a heat-resistant plastic member, for example, and serves to not only hold the heater 11, but also guide the rotation of the fusing film 13.

In the above-explained fuser of the film heating type using the thin fusing film 13, the ceramic heater 11 as the heating member has high rigidity and the press roller 20 having the elastic layer 22 is brought into pressure contact with the ceramic heater 11. In the pressure contact region, therefore, the press roller 20 is flattened following a flat lower surface of the heater 11 to form the fusing nip portion N with a predetermined width. Quick-start of heating in the fusing step is thus realized by heating mainly the fusing nip portion N alone.

The positional relationship between the heat-generating resistance layer 11*b* of the heater 11 and the press roller 20 in the foregoing construction will be described with reference to FIG. 3. As seen from FIG. 3, the heat-generating resistance layer 11*b* is formed to have a width W in the longitudinal direction slightly narrower than a width D of the elastic layer 22 of the press roller 20 with which the layer 11*b* is brought into contact through the fusing film 13. Stated otherwise, the width W of the heat-generating resistance layer 11*b* is almost equal to or somewhat greater than the feed area of the recording paper P having the toner image t formed and carried thereon.

Consequently, the heat generated upon electric power being supplied to the heat-generating resistance layer 11*b* of the heater 11 is imparted to the recording paper P being transported between the fusing film 13 and the press roller 20, thereby fusing and fixing the toner image t on the recording paper P.

Further, S represents a reference for feed of the recording paper. The image forming apparatus of this embodiment is of the one-side reference type that a recording paper feed system of the apparatus is designed to have the reference S set to one end of the paper feed area in a direction vertical to the direction of feed of the recording paper.

In addition, as shown in FIG. 3, the temperature sensor 14 such as a thermistor and a thermo-protector 15 such as a temperature fuse or a thermo-switch for shutting down the supply of electric power to the heat-generating resistance layer 11*b* of the heater 11 in the event of runaway are provided in contact with the back surface of the heater 11. These components 14, 15 are arranged within the feed area of the recording paper P having a minimum width as small as capable of being fed by the image forming apparatus.

Specifically, the temperature sensor 14 is located within the minimum feed area of the recording paper so that even when the recording paper P having a minimum width as small as capable of being fed by the image forming apparatus is fed, the toner image t on the recording paper P can be heated and fixed at an appropriate fusing temperature without undergoing problems such as a fusing failure and a high-temperature offset. Also, the thermo-protector 15 is located within the minimum feed area of the recording paper to avoid such a problem that even during the normal feed condition, the supply of electric power may be shut down upon malfunction of the thermo-protector 15 because of overheating possibly occurred in the non-feed area where heat resistance is smaller than in the feed area when the recording paper P having the minimum width is fed. In this connection, the arrangement of the thermo-protector 15 in contact with the heater 11 may result in a condition where the heat generated by the heat-generating resistance layer 11*b* is reduced too much by the thermo-protector 15 to provide the recording paper P with a sufficient amount of heat, and a fusing failure occurs in the position where the thermo-protector 15 contacts the heater 11. To avoid such a drawback, in a portion of the heat-generating resistance layer 11*b* of the heater 11 corresponding to the position where the thermo-protector 15 contacts the heater 11, the width of the heat-generating resistance layer 11*b* is slightly narrowed, as indicated by 11*b*', to increase a resistance value in that portion of the layer 11*b* as compared with the other portion, thereby ensuring the amount of heat generated. It is hence possible to make uniform the amount of heat supplied to the recording paper P over the entire feed area in the longitudinal direction, and to realize satisfactory heating and fusing without unevenness in fixation of the toner image. Since the temperature sensor 14 is similarly arranged in contact with the back surface of the heater 11, there is also a fear that the heat generated by the heat-generating resistance layer 11*b* is too much taken away by the temperature sensor 14. But, by using the temperature sensor 14 which has small thermal capacity, e.g., a chip thermistor, the amount of heat taken away from the heater 11 can be reduced to a very small amount. With no need of the above-stated measures taken for the thermo-protector 15, therefore, the toner image can be uniformly fused and fixed without impairing evenness in fixation of the toner image to the recording paper over the entire feed area in the longitudinal direction.

When the recording paper P having an unfixed toner image formed thereon, as mentioned above, is introduced between the fusing film 13 and the press roller 20 in the fusing nip portion N, the recording paper P is brought into close contact with the fusing film 13 and transported through the nip portion N along with the fusing film 13 while being held in sandwiched relation. With the heat imparted from the heater 11, which is adjusted to provide the predetermined fusing temperature by temperature control, and the pressing force applied in the nip portion N, the not-yet-fused toner image is heated, fused and fixed as a permanent image on the recording paper P.

Figure 4A:
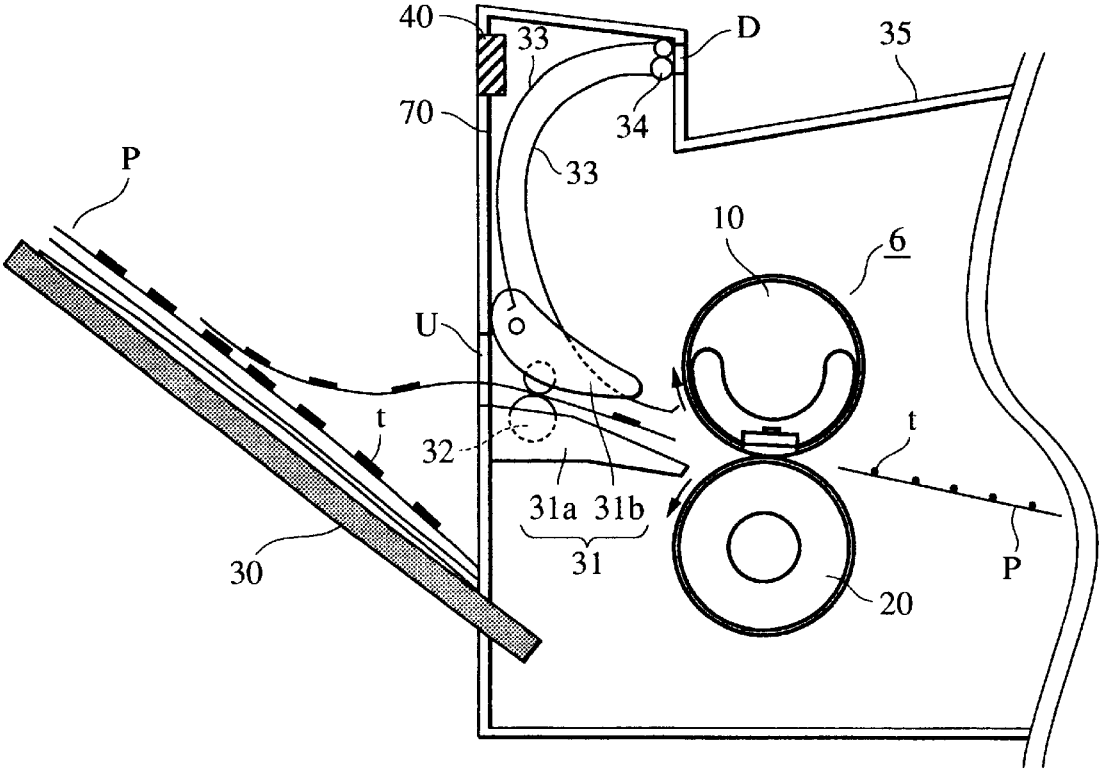
FIGS. 4A and 4B are partial views for explaining paper ejection sections used respectively in the F/U paper ejection mode and the F/D paper ejection mode.
Figure 4B:
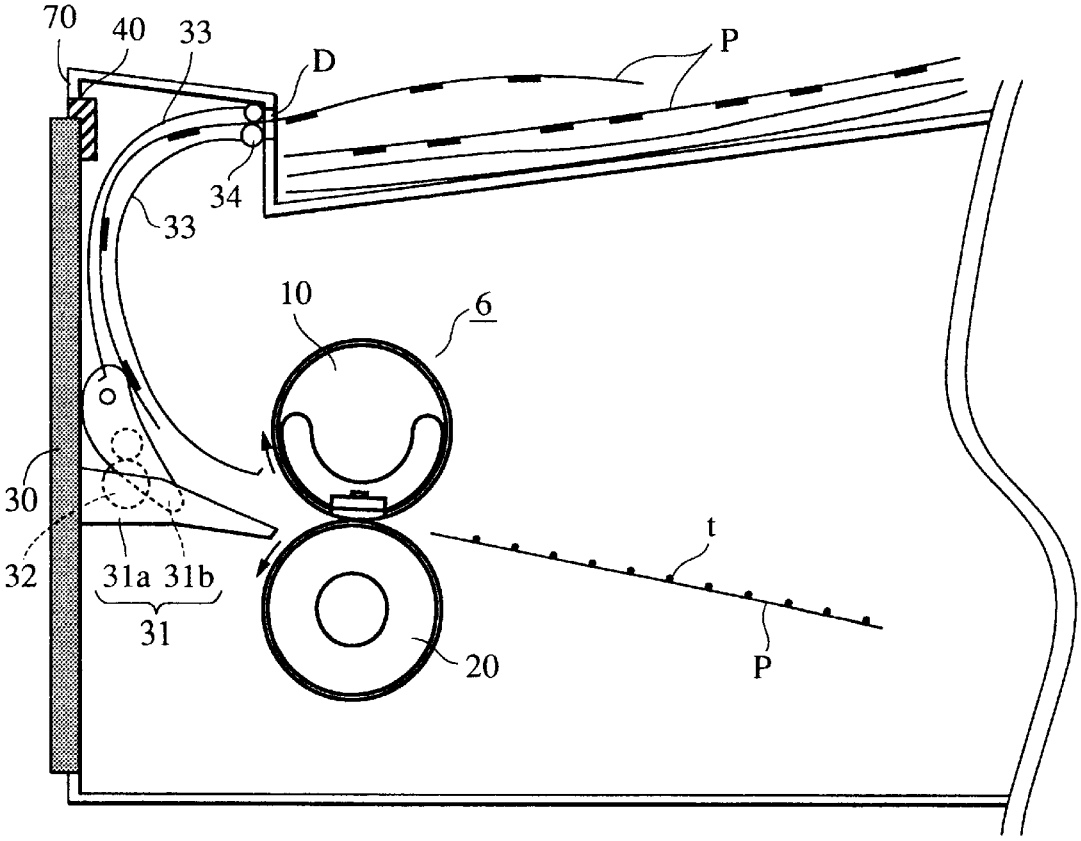

FIGS. 4A and 4B are schematic views for explaining ejection sections into which the recording paper P after the fusing step is ejected.

In FIGS. 4A and 4B, denoted by U is a first ejection opening through which the recording paper P is ejected with its surface having the permanent image thereon facing up (F/U paper ejection mode), and D is a second ejection opening through which the recording paper P is ejected with its surface having the permanent image thereon facing down (F/D paper ejection mode).

Denoted by 30 is an F/U tray, as a first ejection section, which is provided to be able to open and close with respect to an apparatus frame 70. When the F/U tray 30 is in an open condition, the recording paper P ejected through the first ejection opening U is stacked one by one on the F/U tray 30. Denoted by 31*a* is a lower feed guide provided downstream of the heating type fuser, and 31*b* is an ejection path switching member (flapper) which is swung in interlock with opening/closing of the F/U tray 30 for switching a feed path of the recording paper P from one to the other. When the F/U tray 30 is opened, the ejection path switching member 31*b* is swung upward for introducing the recording paper P to the first ejection opening U. When the F/U tray 30 is closed, the ejection path switching member 31*b* is swung downward for introducing the recording paper P to the second ejection opening D.

From the standpoint of reducing the apparatus size, a set of paper ejection guides 31 (31*a*, 31*b*) are disposed immediately downstream of the fuser 6 in the direction of paper of the recording paper, and the frame 70 is located just behind the paper ejection guides 31. When the F/U tray 30 is opened, the paper ejection guides 31 are exposed to the exterior through the first ejection opening U. Denoted by 32 is a paper ejection roller for ejecting the recording paper to the F/U tray 30.

Denoted by 33 is an upper feed guide for guiding the recording paper P to the second ejection opening D, 34 is a pair of paper ejection rollers for ejecting the recording paper P out of the apparatus, 35 is an F/D tray, as a second ejection section, on which the recording paper P ejected through the second ejection opening D is stacked one by one, and 40 is a sensor for detecting whether the F/U tray 30 is opened or closed.

The ejection path switching member 31*b*, the upper feed guide 33, the paper ejection rollers 34, etc. jointly constitute reversing means for reversing the recording paper, that is, turning the recording paper upside down. The recording paper having passed the fuser 6 is reversed by the reversing means and then ejected to the F/D tray 35.

Thus, in this embodiment, the recording paper can be fed in either a first mode in which the recording paper having passed the fuser 6 is ejected to the first ejection section 30 directly without being reversed or a second mode in which the recording paper having passed the fuser 6 is ejected to the second ejection section 35 after being reversed by the reversing means.

In this embodiment, since the toner image passes the fuser while being carried on the upper surface of the recording paper, the first mode corresponds to an F/U paper ejection mode and the second mode corresponds to an F/D paper ejection mode.

In the image forming apparatus constructed as stated above, as the process speed increases, sheets of recording paper ejected from the fuser 6 are stacked one above another in a condition where the sheet temperature still remains high and the static electricity charged on the sheets are not yet attenuated.

Particularly, when the sheets of recording paper are ejected in the F/U paper ejection mode with the F/U tray 30 made open as shown in FIG. 4A, the above tendency is more remarkable and a problem may occur in quality of stacked prints because the feed path of the recording paper includes no reversing means or the like and the recording paper P is ejected immediately after being fed out of the fuser and stacked on the recording paper P already put in the F/U tray 30 along its printed surface. Accordingly, when sheets of recording paper of which temperature still remains high when ejected, such as OHP sheets, are fed in the F/U paper ejection mode, the OHP sheets are stacked one above another in a condition where the toner on each sheet is not solidified sufficiently. This may result in that the OHP sheets cannot be stacked satisfactorily because the adhesive force of the toner, the force of remained static electricity, etc. cause the sheets to stick to each other or curl.

In addition, since the sheets of recording paper are ejected in the F/U paper ejection mode with the F/U tray 30 made open, there is a problem that the paper ejection guides 31 located near the fuser, including the lower feed guide 31*a* and the ejection path switching member 31*b*, are exposed to the exterior and those members are heated excessively although the user may easily touch them.

In this embodiment, therefore, the F/U paper ejection mode is performed according to a control sequence by which a throughput of sheets of recording paper fed in the F/U paper ejection mode is reduced to such an extent that the sheets are stacked satisfactorily and the paper ejection guides 31 are avoided from being heated excessively. The term "throughput" used in this specification means the number of sheets of recording paper (prints) ejected per unit time (ppm) from the image forming apparatus.

The throughput at which printed OHP sheets can be stacked with good quality in the F/U paper ejection mode without suffering from sticking and curling was first measured. The results are shown in Table 1 below.

TABLE 1

Dependency of Quality of OHP Prints Stacked in F/U Paper Ejection Mode upon Throughput

| Throughput | 12 ppm | 14 ppm | 16 ppm |
|---|---|---|---|
| Stacked Print Quality | ○ | Δ | x |

○. . . neither sticking nor curling occurred,
Δ. . . ticking and curling occurred rarely, and
x . . . sticking and curling occurred.

As seen from Table 1, by reducing the throughput down to 12 ppm, the quality of OHP sheets stacked in the F/U paper ejection mode can be improved.

Next, measurement was conducted on dependency of a temperature rise of the paper ejection guides 31 upon the throughput in the F/U paper ejection mode. The results are shown in Table 2 below. Note that the temperature rise was determined based on a sensory test of touching the paper ejection guides 31 by the hand after the paper ejection guides 31 had been sufficiently heated by printing 500 sheets of plain paper (corresponding to one cassette) in a cassette paper feed manner.

TABLE 2

Dependency of Temperature Rise of Fused-Paper Ejection Members upon Throughput

| Throughput | 9 ppm | 12 ppm | 16 ppm |
|---|---|---|---|
| Temperature Rise | ○ | Δ | x |

○. . . very hot,
Δ. . . hot, and
x . . . not so hot.

As seen from Table 2, it is necessary to reduce the throughput down to 9 ppm for preventing the paper ejection guides from being heated excessively in the F/U paper ejection mode.

Taking into account the results mentioned above, in this embodiment, when the control means 60 detects based on a signal from the opening/closing sensor 40 that the F/U tray 30 is in a closed condition, it sets the throughput to 16 ppm upon a judgment that the F/D paper ejection mode is to be performed. On the other hand, when the control means 60 detects based on a signal from the opening/closing sensor 40 that the F/U tray 30 is in an open condition, it executes a control sequence for instructing the driving controller 61 to change the feed timing of sheets of recording paper P and reduce the throughput down to 9 ppm, which is smaller than in the F/D paper ejection mode, upon a judgment that the F/U paper ejection mode is to be performed.

As a result of employing the above control sequence, it was proved that the printed sheets of recording paper were stacked with good quality and the paper ejection guides were avoided from being heated excessively even in the F/U paper ejection mode due to a sufficient decrease of the sheet temperature and sufficient attenuation of the remained static electricity.

While the opening/closing sensor 40 is provided as F/U-paper-ejection mode detecting means in the above embodiment near the position where the F/U tray 30 is opened and closed, which paper ejection mode or which ejection opening is to be used can also be judged based on an ejection-opening designation signal from a host computer or a formatter, or a signal from a full-stack sensor (not shown) provided in the F/D paper ejection section. While the above embodiment has been explained as changing only the throughput depending upon which ejection opening is to be used, the present invention can also be practiced by a method of degrading a level of fusing quality for bond paper, etc., i.e., lowering the fusing temperature to a smaller value than in the F/D paper ejection mode, without reducing the throughput, or a method of reducing both the throughput and the fusing temperature. Further, in the above embodiment, the throughput is changed by varying the intervals at which the sheets of recording paper P are supplied. But the present invention is not limited to the explained method, and the throughput may be changed by modifying the process speed, i.e., the moving speed of recording paper.

As stated above, according to the first embodiment, by changing at least one of the supply intervals of the sheets of recording paper and the fusing temperature thereof in the F/U paper ejection mode, it is possible to improve the quality of stacked prints and to prevent the paper ejection guides 31, which are located near the first ejection opening, from being heated excessively.

(Second Embodiment)

This second embodiment employs a control sequence of reducing the throughput or the fusing temperature in the F/U paper ejection mode after the predetermined number of sheets of recording paper have been printed. The other conditions are the same as in the above first embodiment and therefore will not be explained again.

Sticking and curling of OHP sheets in the F/U paper ejection mode are more likely to occur when a certain number of sheets are stacked on the F/U tray 30 and the ejected sheets become hard to cool quickly. Also, the temperature of the paper ejection guides moderately rises by the heat carried with the sheets and then reaches a saturated temperature after passage of several hundred sheets through the paper ejection guides.

In this embodiment, therefore, after the predetermined number of sheets of recording paper have been printed in the F/U paper ejection mode, the throughput or the fusing temperature is reduced so that the quality of prints stacked in the F/U paper ejection mode can be improved and the paper ejection guides 31 can be prevented from being heated excessively without deteriorating the printing performance in practical use.

The number of prints at which the stacked OHP sheets experienced sticking and curling in the F/U paper ejection mode was first measured. The results are shown in Table 3 below. Note that printing of the OHP sheets was started from after the fuser 6 was sufficiently warmed to create a basic condition for measurement of the occurrence of sticking and curling.

TABLE 3

Dependency of Quality of OHP Prints Stacked in F/U Paper Ejection Mode upon Nuinber of Prints (at 16 ppm)

| Number of Prints | 1–5 sheets | 6–10 sheets | 11–15 sheets | 16–20 sheets |
|---|---|---|---|---|
| Stacked Print Quality | ○ | Δ | Δ | x |

x . . . curing occurred frequently,
Δ. . . curing occurred rarely, and
○. . . no curing occurred.

Next, measurement was conducted on dependency of a temperature rise of the paper ejection guides 31 upon the number of prints. The results are shown in Table 4 below.

TABLE 4

Dependency of Temperature Rise of Fused-Paper Ejection Members upon Number of Prints (at 16 ppm)

| Number of Prints | after 50 | after 100 | after 200 |
|---|---|---|---|
| Temperature Rise | ○ | Δ | Δ |

x . . . very hot,
Δ. . . hot,
and ○. . . not so hot.

Taking into account the results mentioned above, in this embodiment, when the control means 60 detects that the sheets are ejected in the F/U paper ejection mode, it performs a control sequence of starting the printing at the throughput of 16 ppm and then reducing the throughput down to 9 ppm smaller than in the F/D paper ejection mode after 15 sheets have been printed.

As a consequence of employing the above control sequence, it was proved that the quality of prints stacked in the F/U paper ejection mode was improved and the paper ejection guides 31 were prevented from being heated excessively without deteriorating the printing performance in substance.

Alternatively, by lowering the fusing temperature instead of changing over the throughput, it is also possible to ensure the good quality of the stacked prints and to prevent the paper ejection guides 31 from being heated excessively.

Further, if the fusing temperature is lowered in addition to change of the throughput, the throughput can be changed over at a larger number of prints and the average throughput can be maintained higher eventually. As a result, a decrease of the throughput can be held down to a minimum.

As stated above, according to this second embodiment, by reducing at least one of the throughput and the fusing temperature after the predetermined number of sheets of recording paper have been printed in the F/U paper ejection mode, the quality of prints stacked in the F/U paper ejection mode can be improved and the paper ejection guides 31 can be prevented from being heated excessively without deteriorating the printing performance in most practical cases.

(Third Embodiment)

In this third embodiment, the predetermined number of prints at which the throughput is changed over in the above second embodiment is made different depending upon the state (temperature) of the fuser 6. The remaining construction is the same as in the above first embodiment and therefore will not be explained again.

Sticking and curling of OHP sheets in the F/U paper ejection mode are more likely to occur when printing is started from a condition of the fuser 6 being warmed sufficiently than when printing is started from a condition of the fuser 6 being cooled down, because the prints are ejected at a higher temperature in the former case. This embodiment therefore employs a control sequence of knowing the state of the fuser 6 from the temperature detected by the thermistor (temperature sensor) 14 provided on the heater 11, and determining the predetermined number of prints, at which at least one of the throughput and the fusing temperature is to be changed over in the F/U paper ejection mode, depending upon the state of the fuser 6.

Figure 5:
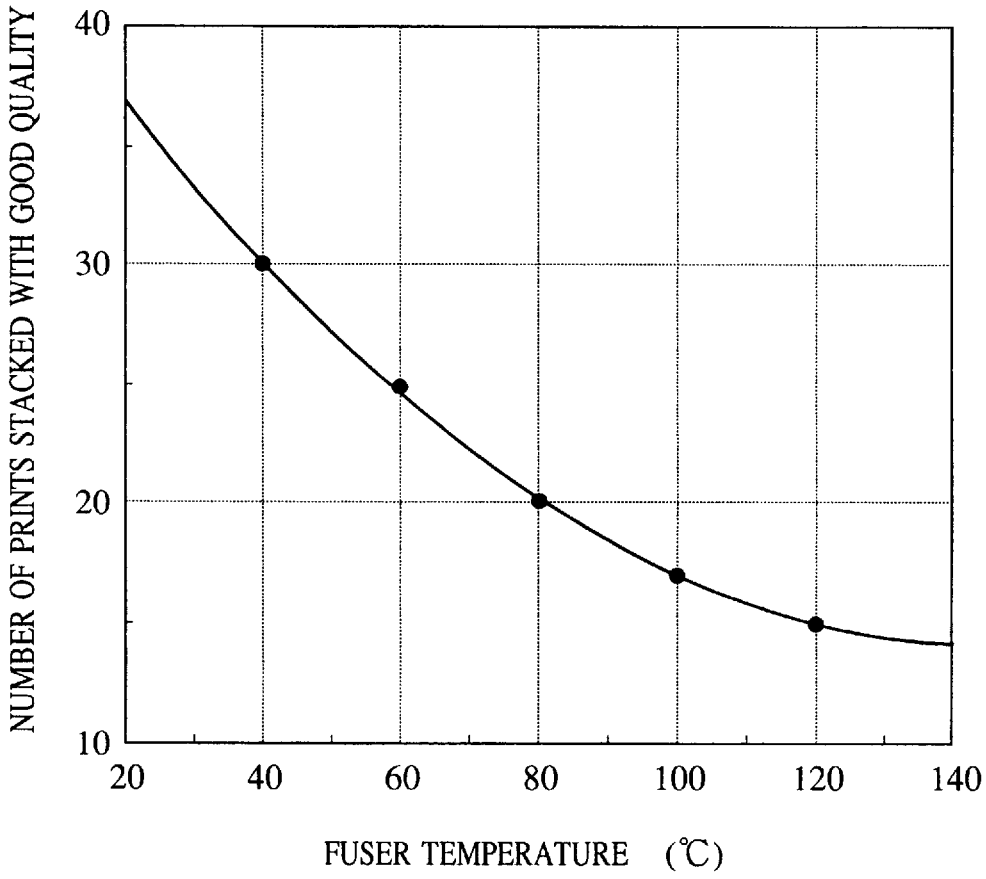
FIG. 5 is a graph showing dependency of the number of OHP sheets, at which the sheet begins sticking to another and curling, upon the fuser temperature in the F/U paper ejection mode.

The relationship between the number of prints at which the printed OHP sheets can be stacked with good quality in the F/U paper ejection mode without suffering from sticking or curling and the fuser temperature at the start of printing was first measured. The results are shown in FIG. 5.

Based on the results of FIG. 5, the control means 60 is designed in this embodiment such that when printing is started in the F/U paper ejection mode, the number of prints at which the throughput is to be changed over is determined depending upon the temperature of the fuser 6 as shown in Table 5 below. Specifically, the printing is started at the throughput of 16 ppm and after the number of prints listed in each column depending upon the fuser temperature have been ejected, the throughput is reduced down to 9 ppm.

TABLE 5

Dependency of Number of Prints upon Initial Temperature Rise of Fused-Paper Ejection Members (for changeover from 16 ppm to 9 ppm)

| Fuser Temperature | below 40° C. | from 40° C. to 80° C. | above 80° C. |
|---|---|---|---|
| Number of Prints at Changeover | 30 | 20 | 15 |

By reducing the throughput after printing of the predetermined number of sheets depending on the fuser temperature at the start of the printing, as shown in Table 5, it was proved that OH sheets were kept from sticking or curling when ejected in the F/U paper ejection mode, and the paper ejection guides 31 was prevented from being heated excessively, while achieving a further improvement of the printing speed.

Alternatively, by setting the fusing temperature to a lower value at the start of printing when in the F/U paper ejection mode, it is possible to delay the timing of changeover of the throughput, i.e., to increase the number of prints, at which the throughput is to be changed over, from the number of prints shown in Table 5 for each range of the fuser temperature.

As stated above, according to this third embodiment, by determining the preset number of prints, at which the throughput or the fusing temperature is to be changed over in the F/U paper ejection mode, depending upon the state (temperature) of the fuser 6, the quality of the prints stacked in the F/U paper ejection mode can be improved and the paper ejection guides 31 can be prevented from being heated excessively. In addition, the throughput as high as possible depending upon the state of the fuser 6 can be achieved.

(Fourth Embodiment)

In this fourth embodiment, several fusing modes (such as a rough paper mode and an OHP mode) adapted for various kinds of paper are prepared and at least one of the throughput and the fusing temperature for sheets of recording paper is changed over in the F/U paper ejection mode depending upon the fusing temperature fit for each of the fusing modes. The other conditions are the same as in the above embodiments and therefore will not be explained again.

In the image forming apparatus of this embodiment, there are prepared three fusing modes; i.e., a normal mode, a rough paper mode and an OHP mode. These fusing modes have respective roles below.

The normal mode is a default mode which is executed when no special instruction is given from the user, and which is suitable for printing on plain paper. The rough paper mode is a mode intended to improve a fusing of the toner image onto paper having a poor surface for toner, thick paper, etc. by delaying the time of first printing in comparison with that in the normal mode and reducing the throughput for carrying out printing while holding the temperature of the press roller relatively high. The final temperature set by temperature control in the rough paper mode is therefore higher than in the other modes. The OHP mode is a mode in which the quality of OHP sheets printed in the F/U paper ejection mode is improved by lowering the fusing temperature.

Figure 6:
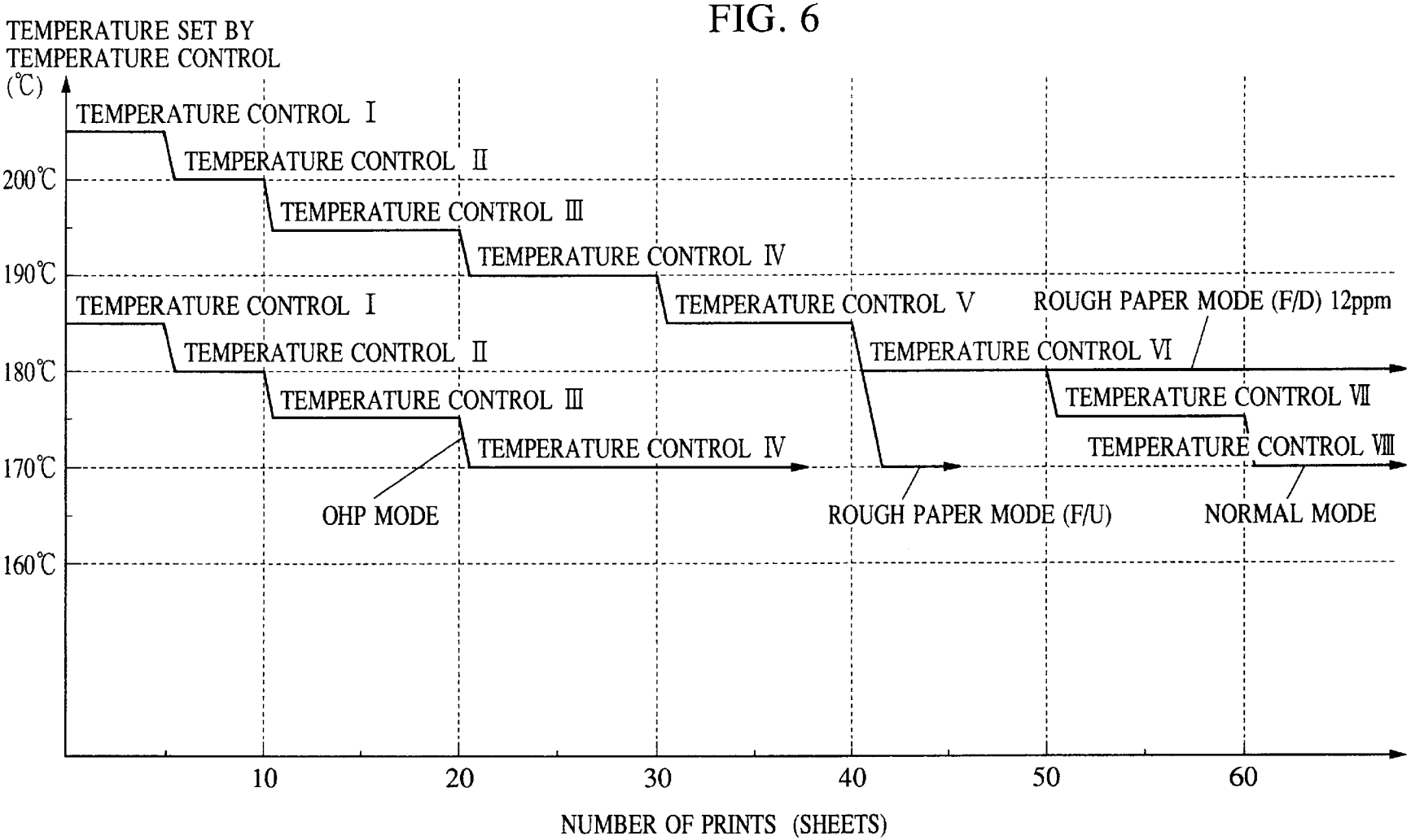
FIG. 6 is a graph showing the temperature set by temperature control in various fusing modes during continuous printing.
Figure 7:
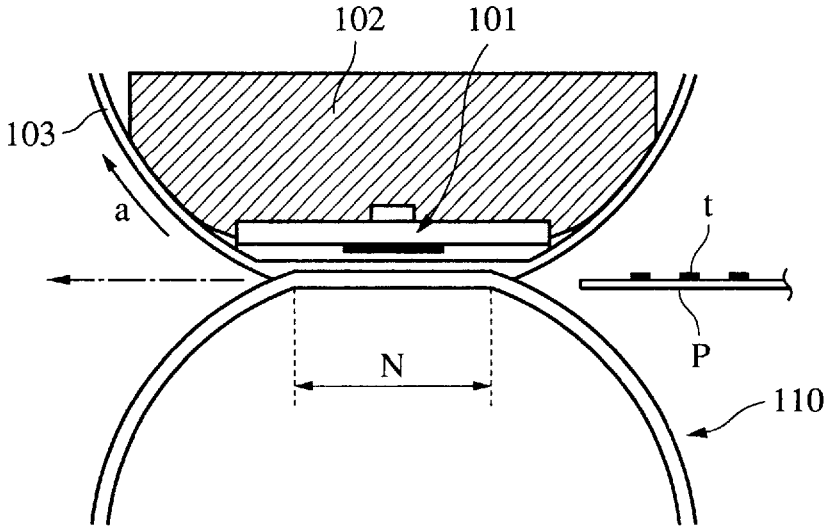
FIG. 7 is a schematic view of principal part of a heating type fuser.
Figure 8A:
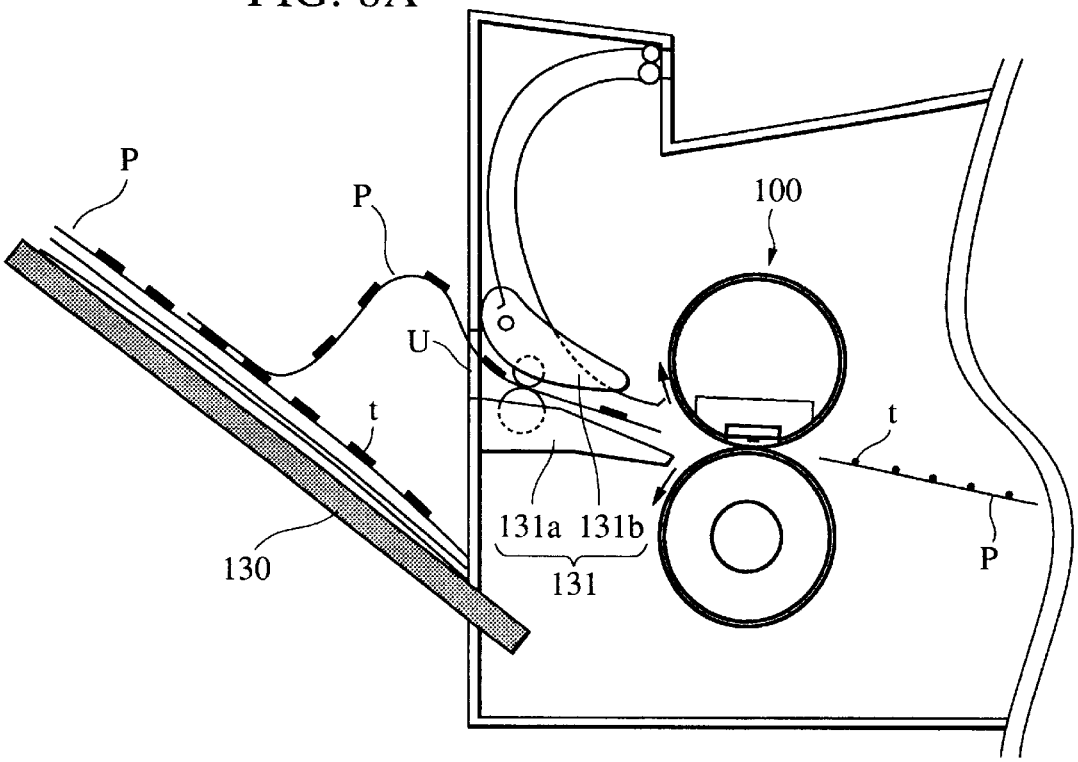
FIGS. 8A and 8B are partial views for explaining paper ejection sections of an image forming apparatus as the background art of the present invention.
Figure 8B:
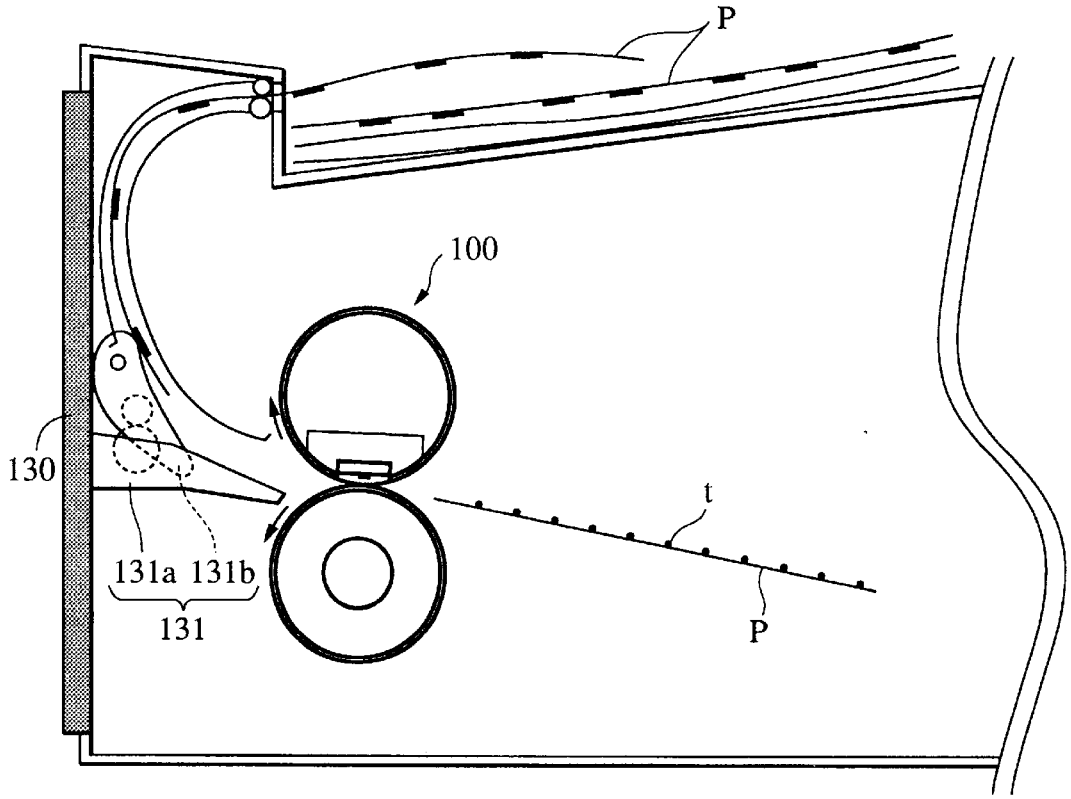

In this embodiment, when the sheets of recording paper are continuously printed, the fusing temperature is changed depending upon the number of prints (i.e., as the press roller 20 is warmed) for each of the fusing modes, as shown in FIG. 6. When the sheets of recording paper are intermittently printed, the fusing temperature at the start of printing is changed in accordance with the state (warmed-up condition) of the fuser 6 (e.g., the printing is started from temperature control II).

Here, since the problem relating to the quality of stacked prints is overcome by preparing the mode adapted for the kind of paper being poor in quality of prints thereof stacked in the F/U paper ejection mode, such as OHP sheets, studies were conducted on only a temperature rise of the paper ejection guides 31.

The temperature rise of the paper ejection guides 31 in each of the fusing modes was first measured. The results are shown in Table 6 below.

TABLE 6

Temperature Rise of Fused-Paper Ejection Members in F/U Paper Ejection Mode for Each Fusing Mode

| Fusing Mode | Normal Mode | Rough Paper Mode | OHP Mode |
|---|---|---|---|
| 70 sheets | ○ | ○ | ○ |
| 100 sheets | ○ | Δ | ○ |
| 200 sheets | Δ | x | ○ |
| 500 sheets | Δ | x | Δ |

x . . . very hot,
Δ. . . hot,
and ○. . . not so hot.

In continuous printing, as seen from Table 6, the paper ejection guides 31 are not heated excessively until about 70 sheets, but when the number of printed sheets exceeds 100, the temperature rise of the paper ejection guides 31 reaches a level of Δ depending on the fusing mode. In this embodiment, therefore, when the final temperature set by temperature control is reached in each of the fusing modes (normal mode=61 sheets, rough paper mode=41 sheets, and OHP mode=21 sheets) in the F/U paper ejection mode, the fusing temperature was lowered down to 170° C. and the throughput was reduced down to 9 ppm. Stated otherwise, only the throughput was changed in both the normal mode and the OHP mode, whereas both the throughput and the fusing temperature were changed in the rough paper mode. The results of the measured temperature rise of the paper ejection guides 31 for each of the fusing modes in accordance with such a control sequence of this embodiment are shown in Table 7 below.

TABLE 7

Temperature Rise of Fused-Paper Ejection Members in Each Fusing Mode

| Fusing Mode | Normal Mode | Rough Paper Mode | OHP Mode |
|---|---|---|---|
| 100 sheets | ○ | ○ | ○ |
| 500 sheets | ○ | ○ | ○ |

x . . . very hot,
Δ. . . hot, and
○. . . not so hot.

It was shown, as seen from Table 7, that by using the above-mentioned sequence, the paper ejection guides 31 were prevented from being heated excessively in the practical condition of use without deteriorating the printing performance. Also, the problem of causing an unsatisfactory failure of fusing was not encountered in any of the fusing modes.

This embodiment has been explained as changing the throughput and the fusing temperature at the different predetermined numbers of prints depending on the fusing modes. For more simplicity of the control sequence, however, it is also possible to employ a method of changing the throughput and the fusing temperature, for example, at the same predetermined number of prints in all the fusing modes.

As stated above, according to this fourth embodiment, by changing, in a system having a plurality of fusing modes, at least one of the throughput or the fusing temperature at the predetermined number of prints depending on selected one of the fusing modes, the quality of the prints stacked in the F/U paper ejection mode can be improved and the paper ejection guides 31 can be prevented from being heated excessively without deteriorating the printing speed as far as practicable.

It is needless to say that the first and second modes correspond respectively to the F/U and F/D paper ejection modes in the above embodiments, but if the toner image is carried on the lower surface of a sheet of recording paper when passing the fuser, the first and second modes correspond respectively to the F/D and F/U paper ejection modes.

Also, the image forming apparatus of the present invention is not limited to electrophotographic type apparatus, but is also applicable to apparatus utilizing electrostatic recording techniques, etc.

Means for heating the fuser used the image forming apparatus of the present invention is not limited to the heating member (ceramic heater) including a heat-generating resistance element which generates heat when supplied with electric power, as explained in the above embodiments. As an alternative, the fuser may be heated by utilizing electromagnetic heating techniques with which heat is generated by applying magnetic forces to act on a conductive member, or hot roller techniques using a metallic roller which contains a halogen heater or the like therein.

It should be understood that several embodiments of the present invention have been explained above, but the present invention is not limited to the above-explained embodiments and can be practiced in any modified forms within the technical scope of the invention.

What is claimed is:

1. An image forming apparatus operable in at least a first mode and a second mode comprising:

image forming means for forming an unfixed image on a recording material;

fusing means for heating and fixing the unfixed image on the recording material while feeding the recording material; and reversing means for reversing the recording material after passing said fusing means; wherein in the first mode the recording material which has passed said fusing means is ejected to an ejection section directly without being reversed and in the second mode the recording material which passed said fusing means is ejected to an ejection section after being reversed by said reversing means, a throughput of the recording material fed in said first mode being smaller in at least part of an image forming process than a throughput of the recording material fed in said second mode.

2. The image forming apparatus according to claim 1, wherein said throughput is controlled in accordance with a feed interval of the recording material supplied to said fusing means.

3. The image forming apparatus according to claim 1, wherein said throughput is controlled in accordance with a feed speed of the recording material fed through said fusing means.

4. The image forming apparatus according to claim 1, wherein the recording material is stacked in the ejection section such that a surface of the recording material facing up has the image thereon in said first mode, and the recording material is stacked in the ejection section such that a surface of the recording material facing down has the image thereon in said second mode.

5. The image forming apparatus according to claim 1, wherein the ejection section for receiving the recording material in said first mode is different from the ejection section for receiving the recording material in said second mode.

6. The image forming apparatus according to claim 1, wherein said reversing means includes a guide member for guiding movement of the recording material.

7. The image forming apparatus according to claim 1, wherein said fusing means comprises a heating member and a back-up member cooperating with said heating member to form a nip, and the recording material having the unfixed image carried thereon is transported through said nip while being held between said heating member and said back-up member.

8. The image forming apparatus according to claim 1, wherein the throughput in said first mode is changed to a smaller value than the throughput in said second mode after images have been formed on a predetermined number of recording material in said first mode.

9. The image forming apparatus according to claim 8, further comprising temperature detecting means for detecting a temperature of said fusing means, wherein said predetermined number of recording material is changed in accordance with the temperature detected by said temperature detecting means.

10. The image forming apparatus according to claim 8, wherein said fusing means has a plurality of different fusing modes and said predetermined number of recording material is changed in accordance with selected one said fusing mode.

11. An image forming apparatus operable in at least a first mode and a second mode comprising:

image forming means for forming an unfixed image on a recording material;

fusing means for heating and fixing the unfixed image on the recording material;

control means for temperature controlling said fusing means to provide a predetermined fusing temperature; and reversing means for reversing the recording material after passing said fusing means; wherein in the first mode the recording material which passed said fusing means is ejected to an ejection section directly without being reversed and in the second mode the recording material which passed said fusing means is ejected to an ejection section after being reversed by said reversing means, the fusing temperature of said fusing means in said first mode being lower in at least part of an image forming process than the fusing temperature of said fusing means in said second mode.

12. The image forming apparatus according to claim 11, further comprising temperature detecting means for detecting the temperature of said fusing means, wherein the temperature of said fusing means is controlled in accordance with the temperature detected by said temperature detecting means.

13. The image forming apparatus according to claim 11, wherein the recording material is stacked in the ejection section such that surface of the recording material having image thereon face up in said first mode, and the recording material is stacked in the ejection section such that surface of the recording material having image thereon face down in said second mode.

14. The image forming apparatus according to claim 11, wherein the ejection section for receiving the recording material in said first mode is different from the ejection section for receiving the recording material in said second mode.

15. The image forming apparatus according to claim 11, wherein said reversing means includes a guide member for guiding movement of the recording material.

16. The image forming apparatus according to claim 11, wherein said fusing means comprises a heating member and a back-up member cooperating with said heating member to form a nip, and the recording material having the unfixed image carried thereon is transported through said nip while being held between said heating member and said back-up member.

17. The image forming apparatus according to claim 11, wherein the fusing temperature in said first mode is changed to a lower value than the fusing temperature in said second mode after images have been formed on a predetermined number of recording material in said first mode.

18. The image forming apparatus according to claim 17, further comprising temperature detecting means for detecting a temperature of said fusing means, wherein said predetermined number of recording material is determined in accordance with the temperature detected by said temperature detecting means.

19. The image forming apparatus according to claim 17, wherein said fusing means has a plurality of different fusing modes and said predetermined number of recording material is changed in accordance with selected one said fusing mode.

* * * * *

UNITED STATES PATENT AND TRADEMARK OFFICE

CERTIFICATE OF CORRECTION

PATENT NO. : 5,862,435

DATED : January 19, 1999

INVENTOR(S) : MASAHIKO SUZUMI, ET AL.

It is certified that error appears in the above-identified patent and that said Letters Patent is hereby corrected as shown below:

COVER PAGE [57] ABSTRACT,
Line 3, "material," should read --material, and a--.

COLUMN 8,
Line 30, "are" should read --is--.

Signed and Sealed this

Twenty-eighth Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,862,435

DATED : January 19, 1999

INVENTOR(S) : MASAHIKO SUZUMI, ET AL.

It is certified that error appears in the above-indentified patent and that said Letters Patent is hereby corrected as shown below:

COLUMN 9,

Table 2:

"o...very hot,",

"Δ...hot, and", and

"x...not so hot."

should read

--x...very hot,

Δ...hot, and o...not so hot.--.

Signed and Sealed this

Second Day of November, 1999

*Attest:*

*Attesting Officer*

Q. TODD DICKINSON

*Acting Commissioner of Patents and Trademarks*